US009971303B2

(12) United States Patent
Helfer et al.

(10) Patent No.: US 9,971,303 B2
(45) Date of Patent: May 15, 2018

(54) TIMEPIECE RESONATOR MECHANISM

(71) Applicant: ETA SA Manufacture Horlogere Suisse, Grenchen (CH)

(72) Inventors: Jean-Luc Helfer, Le Landeron (CH); Gianni Di Domenico, Neuchatel (CH); Pascal Winkler, St-Blaise (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days. days.

(21) Appl. No.: 15/400,327

(22) Filed: Jan. 6, 2017

(65) Prior Publication Data

US 2017/0220002 A1 Aug. 3, 2017

(30) Foreign Application Priority Data

Jan. 29, 2016 (EP) ..... 16153274

(51) Int. Cl.
*G04B 17/06* (2006.01)

(52) U.S. Cl.
CPC ..... *G04B 17/06* (2013.01)

(58) Field of Classification Search
CPC ..... G04B 17/06; G04B 17/04; G04B 31/02; G04B 15/00; G04B 15/06; G04B 15/08; G04B 17/045; G04B 15/14; G04B 15/02; G04B 15/12; G04B 13/025; G04B 17/063; G04B 17/26; G04B 17/00; G04B 17/20; G04B 17/28; G04B 17/285; G04B 17/02
USPC ..... 368/161, 169, 127, 129–131
See application file for complete search history.

(56) References Cited

U.S. PATENT DOCUMENTS

| | | | | |
|---|---|---|---|---|
| 9,134,705 | B2 * | 9/2015 | Vardi | G04B 15/08 |
| 9,323,222 | B2 * | 4/2016 | Stranczl | G04B 15/14 |
| 9,477,205 | B2 * | 10/2016 | Born | G04B 17/045 |
| 9,581,969 | B2 * | 2/2017 | Stranczl | G04B 17/045 |

FOREIGN PATENT DOCUMENTS

| | | |
|---|---|---|
| EP | 1 013 949 A1 | 6/2000 |
| EP | 2 037 335 B1 | 3/2009 |
| EP | 2 911 012 A1 | 8/2015 |

OTHER PUBLICATIONS

European Search Report dated Aug. 25, 2016 in European application 16153274.2, filed on Jan. 29, 2016 (with English Translation of Categories of Cited Documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A timepiece resonator mechanism with a pivoting weight pivoting about a virtual axis, and including a flexure pivot mechanism and a first and second fixed support to which is attached, by a first resilient assembly and respectively a second resilient assembly which together define the virtual axis, a rotary support carrying the pivoting weight, this flexure pivot mechanism is planar, the first resilient assembly includes, on either side of the virtual axis, a first outer flexible strip and a first inner flexible strip, joined to each other by a first intermediate strip stiffer than each of the latter, together defining a first direction passing through the virtual pivot axis, and the second resilient assembly includes a second flexible strip defining a second direction passing through the virtual pivot axis.

26 Claims, 4 Drawing Sheets

TIMEPIECE RESONATOR MECHANISM

This application claims priority from European Patent application 16153274.2 of Jan. 29, 2016, the entire disclosure of which is hereby incorporated herein by reference.

FIELD OF THE INVENTION

The invention concerns a timepiece resonator mechanism comprising a pivoting weight arranged to rotatably pivot about a virtual pivot axis, said resonator mechanism comprising a first fixed support and a second fixed support to which is attached a flexure pivot mechanism which comprises a rotary support connected to said first fixed support by a first resilient assembly and connected to said second fixed support by a second resilient assembly which defines said virtual pivot axis with said first resilient assembly, said pivoting weight being attached to said rotary support or formed by said rotary support.

The invention also concerns a timepiece movement including at least one such resonator mechanism.

The invention also concerns a watch including at least one movement of this type.

The invention concerns the field of timepiece resonator mechanisms.

BACKGROUND OF THE INVENTION

Flexure pivots with a virtual pivot can substantially improve timepiece resonators. The simplest are crossed-strip pivots, formed of two straight, generally perpendicular, strips that intersect. These two strips may be either three-dimensional in two different planes, or two-dimensional in the same plane, in which case they are as welded at their crossing point.

It is possible to optimise a three-dimensional crossed-strip pivot for an oscillator, to make it isochronous, with a rate that is independent of its orientation in the field of gravity, in two particular ways (independently, or combined):

selecting the position of the crossing of the strips with respect to their clamping point to achieve a rate independent of position;

selecting the angle between the strips to be isochronous, and achieve a rate independent of amplitude.

Such three-dimensional systems. or systems at least on several levels, are known from EP Patent 2911012 in the name of CSEM, which discloses a rotary oscillator for timepieces comprising a support element to allow assembly of the oscillator in a timepiece, a balance wheel, a plurality of flexible strips connecting the support element to the balance wheel and capable of exerting a return torque on the balance wheel, and a felloe mounted integrally with the balance wheel. The plurality of flexible strips comprises at least two flexible strips including a first strip disposed in a first plane perpendicular to the plane of the oscillator, and a second strip disposed in a second plane perpendicular to the plane of the oscillator and secant with the first plane. The geometric axis of the oscillation of the oscillator is defined by the intersection of the first plane and the second plane, this geometric axis of oscillation crossing the first and second strips at 7/8ths of their respective length. This arrangement is known from the work by Wittrick starting from 1948 on flexure pivots.

EP Patent 1013949 in the name of SYSMELEC discloses a pivot formed of a fixed base and a movable member connected by a flexible structure, with an intermediate element connected to the base and the movable element, respectively, by two pairs of flexible arms. Each of the arms includes a joint at each end, formed by semi-circular recesses creating flexible areas. The pivot further comprises a kinematic control circuit connecting the base and the movable element and the intermediate element, such that the angular motion of the intermediate element corresponds to that of the movable element.

These known solutions have drawbacks however:

a pivot with three-dimensional crossed strips cannot be etched in a single two dimensional etch, which complicates manufacture;

a two-dimensional crossed-strip pivot, with strips welded at the crossing point, is four times stiffer than the equivalent three-dimensional pivot, its permitted travel is four times less than the three-dimensional pivot, and it cannot achieve a rate independent of both position and amplitude.

SUMMARY OF THE INVENTION

The invention seeks the advantages of the two known two-dimensional and three-dimensional geometries, in a simple, economical and therefore two-dimensional embodiment.

The invention therefore concerns a timepiece resonator mechanism according to claim 1.

The invention also concerns a timepiece movement including at least one such resonator mechanism.

The invention also concerns a watch including at least one movement of this type.

Thus, the invention is a two-dimensional crossed-strip pivot with two strips that do not cross each other. It includes thin parts that bend, and wide parts which are stiff enough for little or no deformation. Since the wide parts do not participate in the flexure of the strips, any shape can be chosen for such wide parts.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
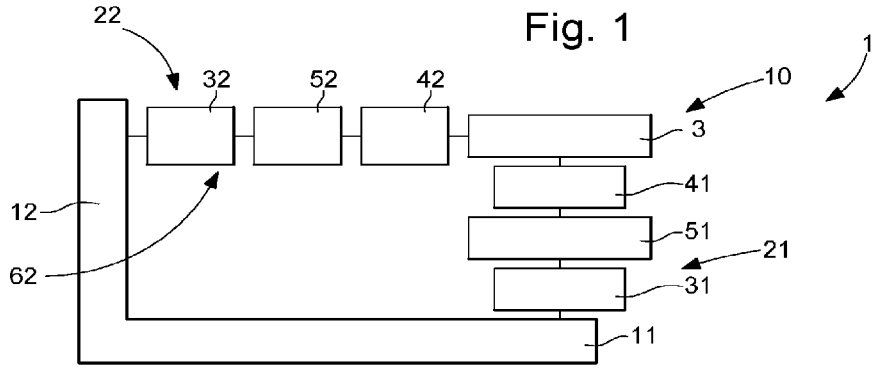
FIG. 1 represents, in the form of a block diagram, the general principle of a mechanical resonator in which a wheel set is suspended to two resilient assemblies arranged in different directions, so as to allow the wheel set only one degree of freedom in rotation in the plane of the sheet.

The invention concerns a timepiece resonator mechanism 1 comprising a pivoting weight 2, which is arranged to rotatably pivot about a virtual pivot axis A.

This resonator mechanism 1 includes a first fixed support 11 and a second fixed support 12, to which is attached a flexure pivot mechanism 10. This flexure pivot mechanism 10 comprises a movable rotary support 3, which is connected to first fixed support 11 by a first resilient assembly 21 comprised in flexure pivot mechanism 10, and is connected to second fixed support 12 by a second resilient assembly 22, also comprised in flexure pivot mechanism 10.

The first resilient assembly 21 and second resilient assembly 22 together define the virtual pivot axis A.

Figure 6:
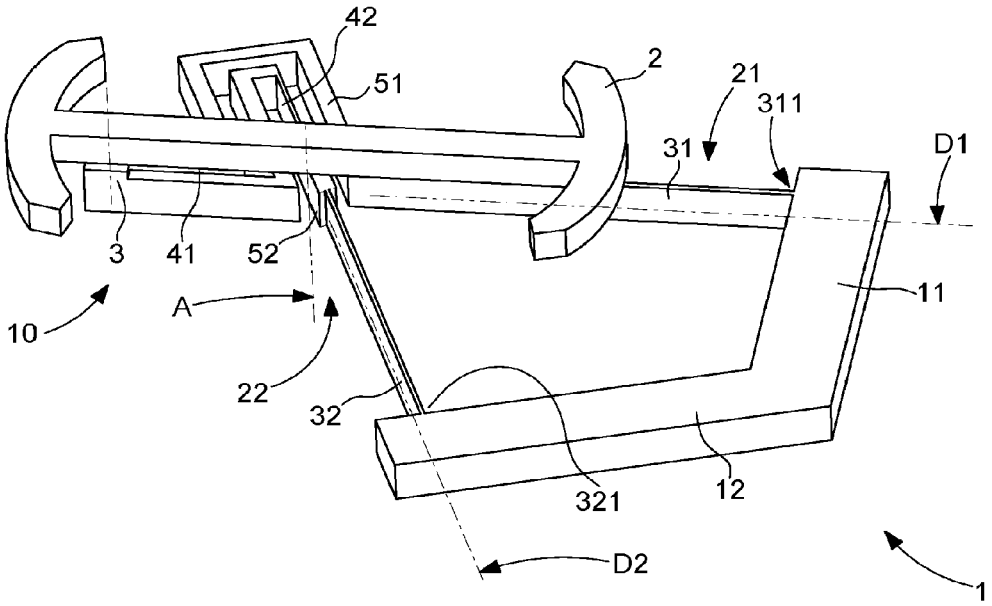
FIG. 6 is a perspective view of the resonator of FIG. 5, with an attached balance eccentrically mounted on the movable rotary support.

Pivoting weight 2 may be attached to rotary support 3, as seen in FIG. 6, or formed by rotary support 3.

According to the invention, flexure pivot mechanism 10 is planar. This means that if flexure pivot mechanism 10 is cut through a plane, the plane cuts each of the elements of which it is formed, and separates the mechanism into two continuous assemblies of the same shape and dimensions, at least in projection onto a plane, and which are, in particular, identical. It is understood that a "planar mechanism" means a mechanism on a single level, in short, it is a three-dimensional object obtained from extrusion of a bidirectional geometry. In particular, this planar flexure pivot mechanism 10, can be manufactured on a single level by a LIGA method or similar.

First resilient assembly 21 includes, on either side of virtual pivot axis A, a first outer flexible strip 31 and a first inner flexible strip 41, joined to each other by a first intermediate strip 51 stiffer than each of the latter. First outer flexible strip 31 and first inner flexible strip 41 together define a first direction D1 passing through virtual pivot axis A. More particularly, first outer flexible strip 31 and first inner flexible strip 41 are disposed on either side of virtual pivot axis A.

Second resilient assembly 22 includes a second flexible strip 62, preferably passing through virtual pivot axis A, and defining a second direction D2, different from first direction D1, passing through virtual pivot axis A where it crosses first direction D1, and forming therewith an angle $\alpha$. In a preferred arrangement, virtual pivot axis A passes right through the middle of the material of second flexible strip 62.

More particularly, first outer flexible strip 31 and first inner flexible strip 41 do not touch each other.

More particularly, first outer flexible strip 31 and first inner flexible strip 41 are each remote from second flexible strip 62.

More particularly, first outer flexible strip 31 and first inner flexible strip 41 form the most flexible parts of first resilient assembly 21. In a particular variant, as illustrated by FIGS. 1 to 8, first resilient assembly 21 includes only first intermediate strip 51, first outer flexible strip 31 and first inner flexible strip 41. In a particular variant, first outer flexible strip 31 and first inner flexible strip 41 have an identical cross-section.

Figure 2:
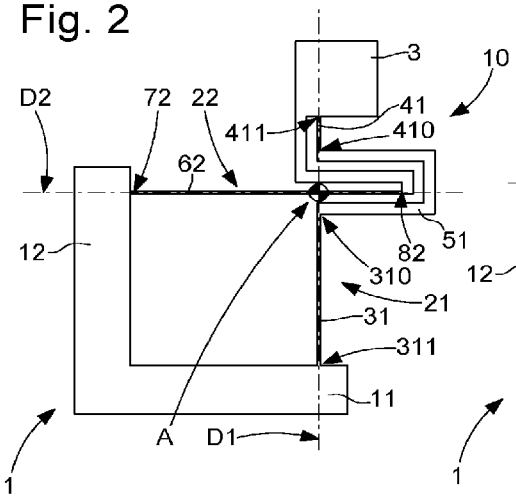
FIG. 2 represents a schematic plan view of a mechanical resonator according to the invention, with a suspended rotary support, and wherein a first resilient assembly includes, on either side of the virtual pivot axis, a first outer flexible strip and a first inner flexible strip, joined to each other by a first intermediate strip stiffer than each of the latter, which together define a first direction passing through the virtual pivot axis, represented on the vertical axis of the Figure, while a second resilient assembly is formed by a strip in the horizontal direction of the Figure, and which passes through the virtual pivot axis.
Figure 3:
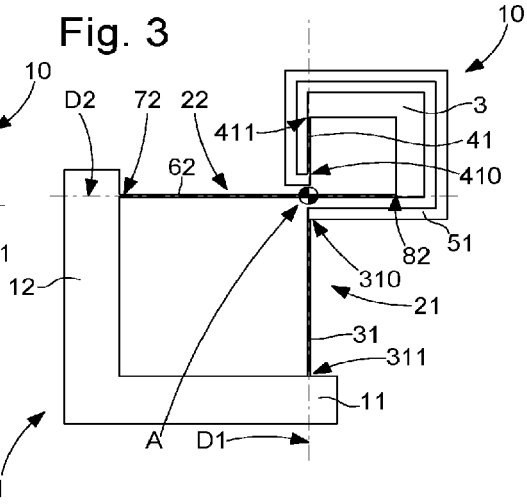
FIG. 3 represents, in a similar manner to FIG. 2, an arrangement of similar strips, but with a first intermediate strip that completely surrounds the movable rotary support, in the plane of the flexure pivot mechanism.
Figure 4:
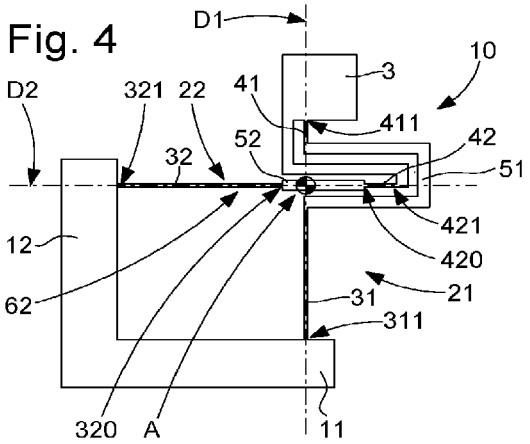
FIG. 4 represents, in a similar manner to FIG. 2, an arrangement of strips wherein the movable rotary support is external to the first intermediate strip, but wherein the second resilient assembly in the horizontal direction includes a second outer flexible strip and a second inner flexible strip, on either side of a second intermediate strip stiffer than each of the latter, this second intermediate strip passing through the virtual pivot axis.

In FIGS. 2 and 3, first resilient assembly 21 and second resilient assembly 22 are of different stiffness. To symmetrize their stiffness, and even their deformation, second resilient assembly 22 may be artificially made thicker at the same place as the first resilient assembly, for example.

Thus, as regards second resilient assembly 22, second flexible strip 62 may be a single strip, as seen in FIGS. 2 and 3, or, like first resilient assembly 21, an alternating series of strips of different flexibility. Thus, in a variant illustrated in FIGS. 1, and 4 to 8, second resilient assembly 22 includes a second outer flexible strip 32 and a second inner flexible strip 42 on either side of a second intermediate strip 52 that is stiffer than each of the latter and forms therewith the second flexible strip 62. In a particular arrangement, second intermediate strip 52 passes through virtual pivot axis A, i.e. it is traversed right through the middle by virtual pivot axis A. In a particular variant, second outer flexible strip 32 and second inner flexible strip 42 have an identical cross-section.

Preferably, first resilient assembly 21 and second resilient assembly 22 are rigidly clamped in first fixed support 11 and respectively second fixed support 12.

More particularly, second flexible strip 62 is clamped in second fixed support 12 at a second outer clamping point 72, and in rotary support 3 at a second inner clamping point 82. The second outer clamping point 72 and second inner clamping point 82 are located on either side of a straight line parallel to direction D1 defined by first resilient assembly 21, and passing through virtual pivot axis A. More particularly, second outer clamping point 72 and second inner clamping point 82 are located on either side of virtual pivot axis A. More particularly still, second outer clamping point 72 and second inner clamping point 82 are aligned with virtual pivot axis A, as seen in the Figures.

Similarly, first inner flexible strip 41 is clamped in fixed support 11 at a first outer clamping point 71, and first outer flexible strip 31 is clamped in rotary support 3 at a first inner clamping point 81.

Although it is possible to envisage that first direction D1 and second direction D2 are curvilinear directions crossing at virtual pivot axis A, modelling is easier with straight elements. Thus, in a particular variant, first direction D1 is straight. In another particular variant, second direction D2 is straight. In yet another particular variant, illustrated in FIGS. 2 to 8, first direction D1 is straight, and second direction D2 is straight.

In particular, first direction D1 is straight and forms the rectilinear direction of at least one elastic strip which is a straight strip, and second direction D2 is straight, and forms the rectilinear direction of at least one elastic strip which is a straight strip.

Similarly, the invention is illustrated in a particular preferred case where the most flexible strips, defining the flexure pivot of flexure pivot mechanism 10, and virtual pivot axis A, are straight flexible strips. Other geometries may nonetheless be envisaged, for example in the form of a serpentine or other.

In a particular manner, first resilient assembly 21 surrounds second resilient assembly 22, in the plane of flexure pivot mechanism 10.

In a particular manner, first intermediate strip 51 completely surrounds movable rotary support 3, in the plane of flexure pivot mechanism 10, as seen in FIG. 3. Whereas, in the variants of FIGS. 2, and 4 to 8, movable rotary support 3 is external to first intermediate strip 51.

Rotary support 3 at the end of the strips thus pivots about a virtual pivot axis A which is at the intersection of the two strip directions. To achieve a rate independent of position in the field of gravity, the instantaneous centre of rotation of both rotary support 3 and pivoting weight 2 which it carries (if applicable) must not move with the angle of rotation. Thus, for optimum operation of resonator mechanism 1, the centre of inertia of the assembly formed by pivoting weight 2 and rotary support 3 is located on virtual pivot axis A. FIG. 6 shows such an example, where pivoting weight 2 is formed by a balance, which is eccentrically attached to rotary support 3.

Figure 8:
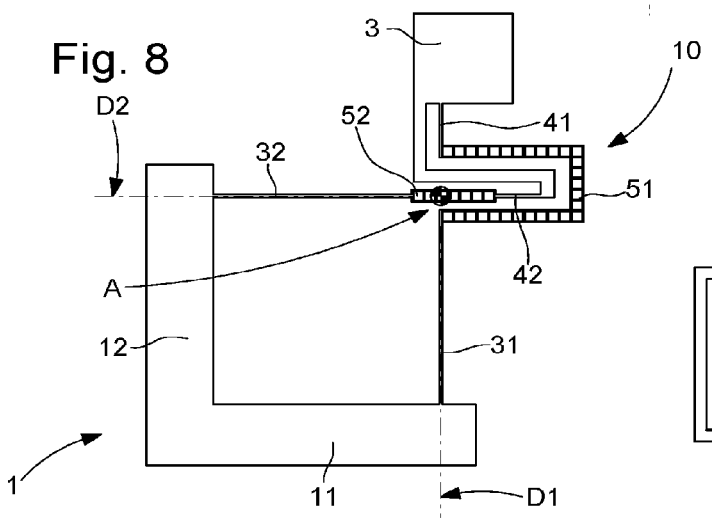
FIG. 8 represents a variant of the resonator of FIG. 5, wherein the first and second intermediate strips are skeletal to reduce their inertia and to avoid undesirable fundamental modes of vibration.
Figure 9:
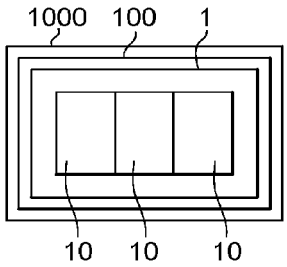
FIG. 9 is a block diagram representing a watch with a movement incorporating a resonator according to the invention, which comprises several flexure pivot mechanisms disposed in series.
Figure 10:
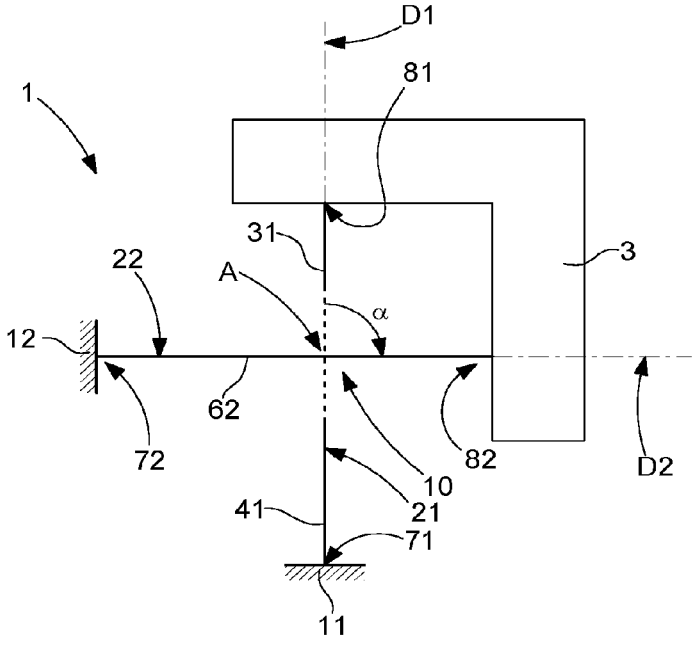
FIG. 10 summarises, in plan view, the geometry of the resonator, devoid here of a first intermediate strip in the first resilient assembly.
Figure 11:
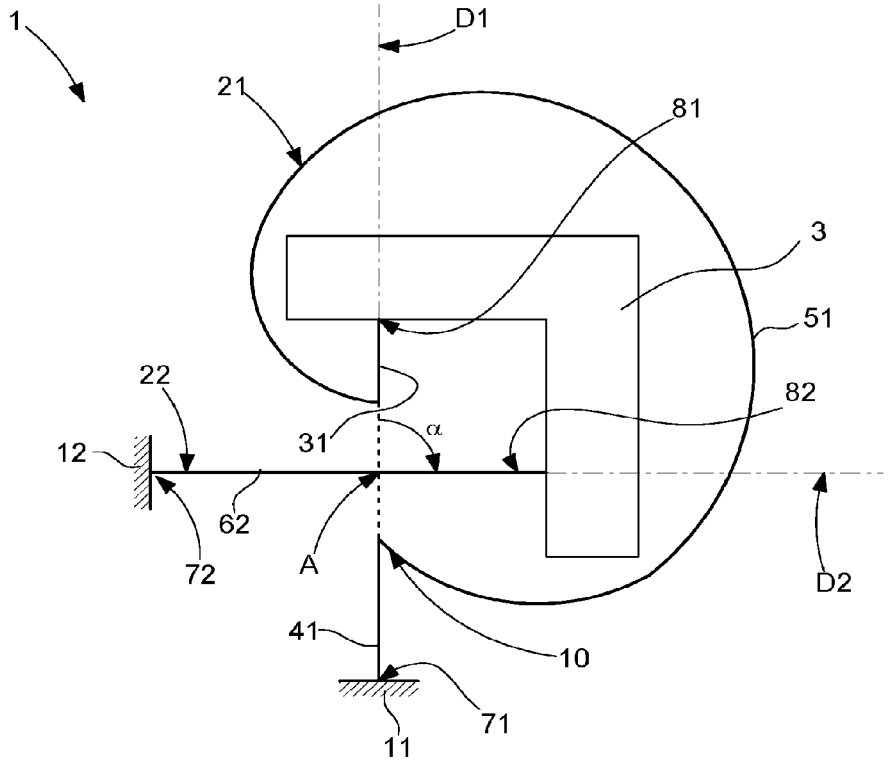
FIG. 11 is similar to FIG. 10 and includes a first intermediate strip of any shape, which completely surrounds the movable rotary support, in the plane of the flexure pivot mechanism.

In an advantageous variant, to minimise the inertial effect of first resilient assembly 21 and of second resilient assembly 22, the least flexible parts of first resilient assembly 21 and/or of second resilient assembly 22 are skeletal to minimise their mass and prevent undesirable fundamental modes of vibration. In fact, this essentially means first intermediate strip 51 and second intermediate strip 52, as seen in FIG. 8.

Advantageously, the outer ends of first resilient assembly 21 and of second resilient assembly 22 are rigidly connected respectively to first fixed support 11 and to second fixed support 12, and the inner ends of first resilient assembly 21 and of second resilient assembly 22 are rigidly connected to rotary support 3.

Figure 5:
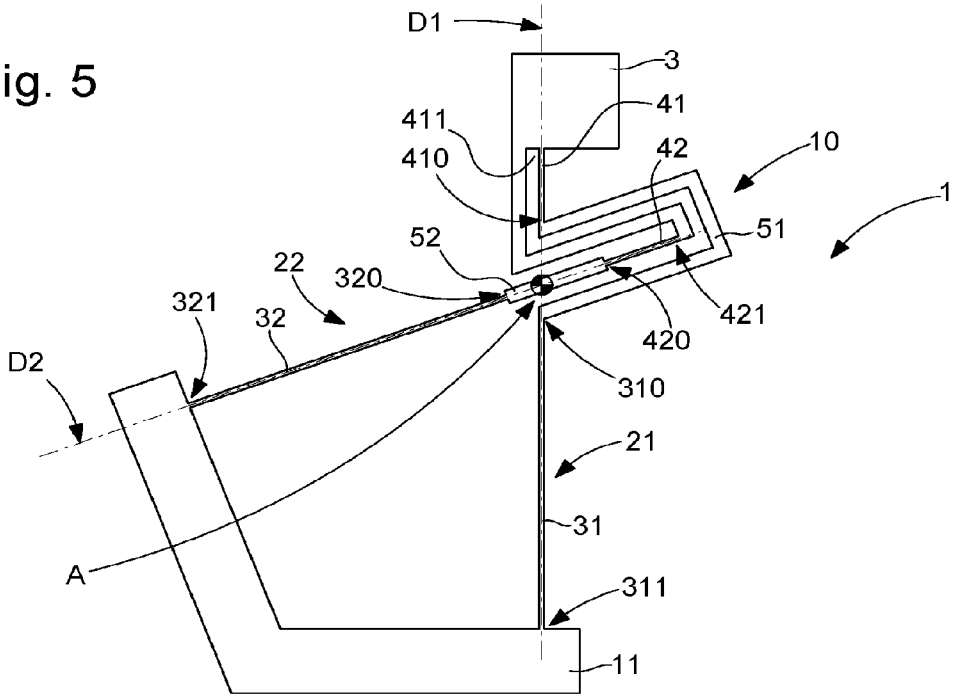
FIGS. 5 and 7 each represent a similar mechanical resonator to that of FIG. 4, but in which the directions of the first resilient assembly and of the second resilient assembly form between them a particular angle favourable to the isochronism of the resonator.
Figure 7:
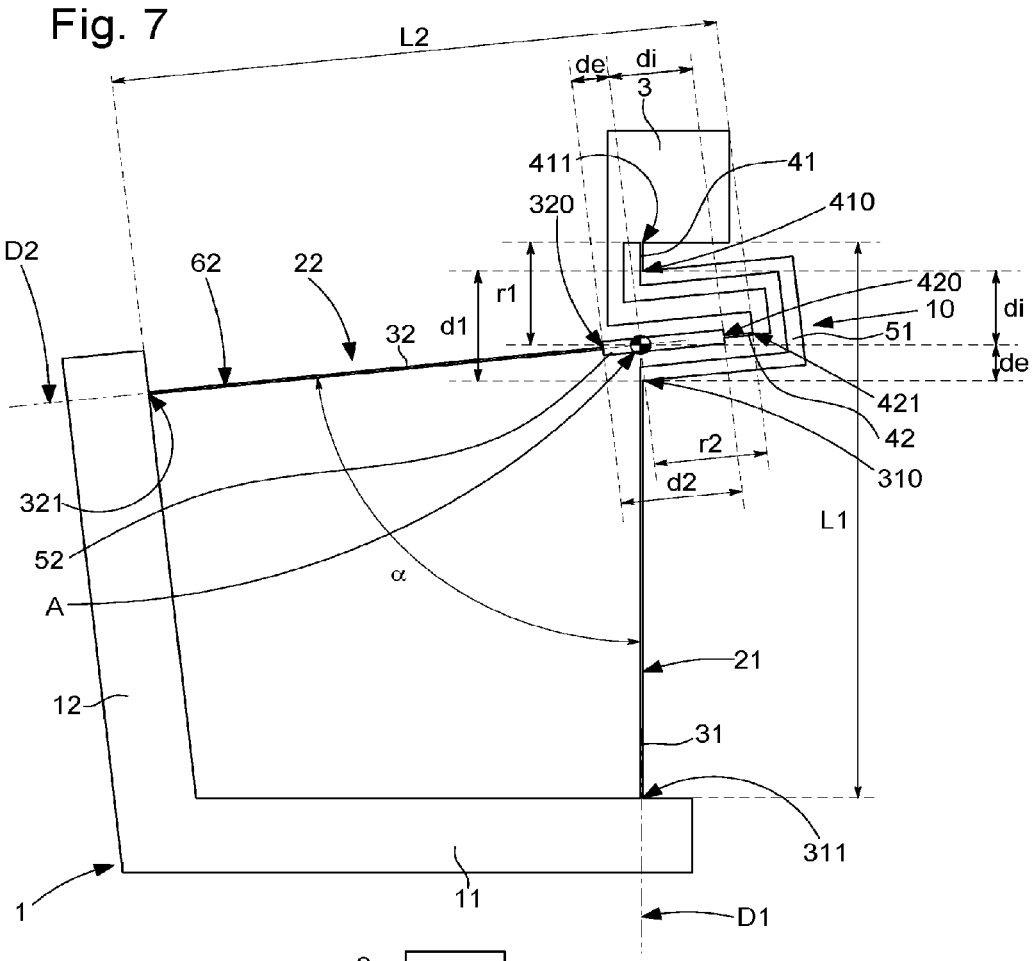

In a particular variant with optimised isochronism, first direction D1 and second direction D2 form with each other an angle comprised between 70° and 87°, and more particularly 83.65°, as seen in FIGS. 5 to 7. CH Patent 01979/14 in the name Swatch Group Research & Development Ltd, incorporated herein by reference, discloses a timepiece resonator with crossed strips and explains the importance of the value of this particular angle.

In order for the rate of resonator mechanism 1 to be as independent as possible of its position in the field of gravity, it is important to determine the position of the crossing of the strip directions, with respect to their clamping point.

In a particular variant, first outer flexible strip 31 is rigidly connected to first intermediate strip 51 at a first outer clamping point 310, first inner flexible strip 41 is rigidly connected to first intermediate strip 51 at a first inner clamping point 410. In an advantageous arrangement, in projection in first direction D1, a first intermediate distance d1 defined by the space between first outer clamping point 310 and the first inner clamping point 410, and a first total distance L1 defined by the space between, on the one hand a first outer clamping point 311 between first outer strip 31 and first fixed support 11, and on the other hand, a first inner clamping point 411 between first inner strip 41 and rotary support 3, define a ratio d1/L1 comprised between 0.05 and 0.25, and notably equal to 0.20.

More particularly still, in projection in first direction D1, a first radius r1 defined by the space between first inner clamping point 411 and virtual pivot axis A, and the first total distance L1, define a ratio r1/L1 comprised between 0.05 and 0.3 and notably equal to 0.185.

Similarly, in a particular variant, second outer flexible strip 32 is rigidly connected to second intermediate strip 52 at a second outer clamping point 320, second inner flexible strip 42 is rigidly connected to second intermediate strip 52 at a second inner clamping point 420. In an advantageous arrangement, in projection in a second direction D2, a second intermediate distance d2 defined by the space between the second outer clamping point 320 and the second inner clamping point 420, and a second total distance L2 defined by the space between, on the one hand a second outer clamping point 321 between second outer strip 32 and second fixed support 12, and on the other hand, a second inner clamping point 421 between second inner strip 42 and rotatory support 3, define a ratio d2/L2 comprised between 0.05 and 0.25, and notably equal to 0.20.

More particularly still, in projection in second direction D2, a second radius r2 defined by the space between second inner clamping point 421 and virtual pivot axis A, and second total distance L2, define a ratio r2/L2 comprised between 0.05 and 0.3, and notably equal to 0.185.

In a particular variant, the first intermediate distance d1, the first total distance L1, the second intermediate distance d2, the second total distance L2, are linked by the relations d1=d2 and L1=L2.

In another particular variant, the first radius r1, the first total distance L1, the second radius r2, the second total distance L2, are linked by the relations r1=r2 and L1=L2.

In another particular variant, d1=d2, and r1=r2, and L1=L2.

For each value of ratio d1/L1=d2/L2, an optimum angle $\alpha$ and an optimum ratio r1/L1=r2/L2 can be found so that the rate is independent of both amplitude and orientation in the field of gravity. Modelling is required to determine the optimum values, and the use of straight flexible strips also facilitates the calculation.

Advantageously, as seen in FIG. 7, the proportions of the stiffest parts 51 and 52 of first resilient assembly 21 and of second resilient assembly 22 between the respective clamping points: 310, 410 and 320, 420, with respect to virtual pivot axis A, where "de" is the distance on the outer side between axis A and the clamping point, and where "di" is the distance on the inner side between axis A and the clamping point, are such that de/(de+di)=⅓ and di/(de+di)=⅔.

The invention is particularly well-suited to a monolithic embodiment. In an advantageous embodiment, first fixed support 11, second fixed support 12 and flexure pivot mechanism 10 form a one-piece assembly. This one-piece assembly can be achieved using MEMS or LIGA type technologies or similar, made of temperature-compensated silicon or similar, notably by specific local growth of silicon dioxide, in some areas of the part arranged for this purpose, when said one-piece assembly is made of silicon.

Timepiece resonator mechanism 1 may comprise a plurality of such flexure pivot mechanisms 10 mounted in series, to increase the total angular travel, disposed in parallel planes, and around the same virtual pivot axis A.

The invention also concerns a timepiece movement 100 including at least one such resonator mechanism 1.

The invention also concerns a watch 1000 including at least one movement 100 of this type.

The invention provides several advantages:

ease of manufacture, owing to the grouping of functional elements in a single plane;

small thickness of the mechanism;

rate independent of position in the field of gravity;

rate independent of amplitude.

What is claimed is:

1. A timepiece resonator mechanism comprising a pivoting weight arranged to rotatably pivot about a virtual pivot axis, said resonator mechanism comprising a first fixed support and a second fixed support, wherein a flexure pivot mechanism is attached to said second fixed support, wherein said flexure pivot mechanism comprises a rotary support connected to said first fixed support by a first resilient assembly and connected to said second fixed support by a second resilient assembly, wherein said second resilient assembly defines said virtual pivot axis with said first resilient assembly, said pivoting weight being attached to said rotary support or formed by said rotary support, wherein said flexure pivot mechanism is planar, wherein said first resilient assembly includes, on either side of said virtual pivot axis, a first outer flexible strip and a first inner flexible strip, joined to each other by a first intermediate strip stiffer than each of the latter, together defining a first direction passing through said virtual pivot axis, and wherein said second resilient assembly includes a second flexible strip defining a second direction passing through said virtual pivot axis, and wherein said second flexible strip is clamped in said second fixed support at a second outer clamping point, and in said rotary support at a second inner clamping point, and wherein said second outer clamping point and said second inner clamping point are located on either side of a straight line parallel to said first direction and passing through said virtual pivot axis.

2. The timepiece resonator mechanism according to claim 1, wherein said first outer flexible strip and said first inner flexible strip are disposed on either side of said virtual pivot axis.

3. The timepiece resonator mechanism according to claim 1, wherein said second outer clamping point and said second inner clamping point are located on either side of a straight line parallel to said first direction defined by said first resilient assembly, and passing through said virtual pivot axis.

4. The timepiece resonator mechanism according to claim 1, wherein said second outer clamping point and said second inner clamping point are aligned with said virtual pivot axis.

5. The timepiece resonator mechanism according to claim 1, wherein said first outer flexible strip and said first inner flexible strip are each remote from said second flexible strip.

6. The timepiece resonator mechanism according to claim 1, wherein said virtual pivot axis passes through the material of said second flexible strip.

7. The timepiece resonator mechanism according to claim 1, wherein said first outer flexible strip and said first inner flexible strip constitute the most flexible parts of said first resilient assembly.

8. The timepiece resonator mechanism according to claim 1, wherein said second resilient assembly includes a second outer flexible strip and a second inner flexible strip on either side of a second intermediate strip that is stiffer than each of the latter and forms therewith said second flexible strip.

9. The timepiece resonator mechanism according to claim 1, wherein there said first direction is straight.

10. The timepiece resonator mechanism according to claim 1, wherein there said second direction is straight.

11. The timepiece resonator mechanism according to claim 1, wherein said first direction is straight and forms the rectilinear direction of at least one elastic strip which is a straight strip, and said second direction is straight and forms the rectilinear direction of at least one elastic strip which is a straight strip.

12. The timepiece resonator mechanism according to claim 1, wherein said first resilient assembly surrounds said second resilient assembly in the plane of said flexure pivot mechanism.

13. The timepiece resonator mechanism according to claim 1, wherein the center of inertia of the assembly formed by said pivoting weight and said rotary support is located on said virtual pivot axis.

14. The timepiece resonator mechanism according to claim 1, wherein the least flexible parts of said first resilient assembly and/or of said second resilient assembly are skeletal to minimize the mass thereof and to prevent undesirable fundamental modes of vibration.

15. The timepiece resonator mechanism according to claim 1, wherein the outer ends of said first resilient assembly and of said second resilient assembly are rigidly connected respectively to said first fixed support and to said second fixed support, and wherein the inner ends of said first resilient assembly and of said second resilient assembly are rigidly connected to said rotary support.

16. The timepiece resonator mechanism according to claim 9, wherein said second direction is straight and wherein said first direction and second direction form with each other an angle comprised between 70° and 87°.

17. The timepiece resonator mechanism according to claim 1, wherein said first outer flexible strip is rigidly connected to said first intermediate strip at a first outer clamping point, wherein said first inner flexible strip is rigidly connected to said first intermediate strip at a first inner clamping point, and wherein, in projection in said first direction which is straight, a first intermediate distance defined by the space between said first outer clamping point and said first inner clamping point, and a first total distance defined by the space between, on the one hand a first outer clamping point between said first outer strip and said first fixed support, and on the other hand, a first inner clamping point between said first inner strip and said rotary support, define a ratio d1/L1 comprised between 0.05 and 0.25.

18. The timepiece resonator mechanism according to claim 17, wherein, in projection in said first direction, a first radius defined by the space between said first inner clamping point and said virtual pivot axis and said first total distance, define a ratio r1/L1 comprised between 0.05 and 0.3.

19. The timepiece resonator mechanism according to claim 1, wherein said second outer flexible strip is rigidly connected to said second intermediate strip at a second outer clamping point, wherein said second inner flexible strip is rigidly connected to said second intermediate strip at a second inner clamping point, and wherein, in projection in said second direction which is straight, a second intermediate distance defined by the space between said second outer clamping point and said second inner clamping point, and a second total distance defined by the space between, on the one hand a second outer clamping point between said second outer strip and said second fixed support, and on the other hand, a second inner clamping point between said second inner strip and said rotary support, define a ratio d2/L2 comprised between 0.05 and 0.25.

20. The timepiece resonator mechanism according to claim 19, wherein, in projection in said second direction, a second radius defined by the space between said second inner clamping point and said virtual pivot axis, and said second total distance, define a ratio r2/L2 comprised between 0.05 and 0.3.

21. The timepiece resonator mechanism according to claim 17, wherein said second outer flexible strip is rigidly connected to said second intermediate strip at a second outer clamping point, wherein said second inner flexible strip is rigidly connected to said second intermediate strip at a second inner clamping point, and wherein, in projection in said second direction which is straight, a second intermediate distance defined by the space between said second outer clamping point and said second inner clamping point, and a second total distance defined by the space between, on the one hand a second outer clamping point between said second outer strip and said second fixed support, and on the other hand, a second inner clamping point between said second inner strip and said rotary support, define a ratio d2/L2 comprised between 0.05 and 0.25, and characterized wherein said first intermediate distance, said first total distance, said second intermediate distance, said second total distance, are linked by the relations d1=d2 and L1=L2.

22. The timepiece resonator mechanism according to claim 18, wherein said second outer flexible strip is rigidly connected to said second intermediate strip at a second outer clamping point, wherein said second inner flexible strip is rigidly connected to said second intermediate strip at a second inner clamping point, and wherein, in projection in said second direction which is straight, a second intermediate distance defined by the space between said second outer clamping point and said second inner clamping point, and a second total distance defined by the space between, on the one hand a second outer clamping point between said second outer strip and said second fixed support, and on the other hand, a second inner clamping point) between said second inner strip and said rotary support, define a ratio d2/L2 comprised between 0.05 and 0.25, wherein, in projection in said second direction, a second radius defined by the space between said second inner clamping point and said virtual pivot axis, and said second total distance, define a ratio r2/L2 comprised between 0.05 and 0.3, and wherein said first radius, said first total distance, said second radius, and said second total distance, are linked by the relations r1=r2 et L1=L2.

23. The timepiece resonator mechanism according to claim 1, wherein said first fixed support, said second fixed support, and said flexure pivot mechanism form a one-piece temperature-compensated silicon assembly.

24. The timepiece resonator mechanism according to claim 1, wherein said resonator mechanism comprises a plurality of said flexure pivot mechanisms mounted in series, to increase the total angular travel, disposed in parallel planes, and around the same said virtual pivot axis.

25. A timepiece movement including at least one timepiece resonator mechanism according to claim 1.

26. A watch including at least one movement according to claim 25.

* * * * *